US007451685B2

(12) United States Patent
Tabor

(10) Patent No.: US 7,451,685 B2
(45) Date of Patent: Nov. 18, 2008

(54) HYDRAULIC CONTROL SYSTEM WITH CROSS FUNCTION REGENERATION

(75) Inventor: Keith A. Tabor, Richfield, WI (US)

(73) Assignee: HUSCO International, Inc., Waukesha, WI (US)

( * ) Notice: Subject to any disclaimer, the term of this patent is extended or adjusted under 35 U.S.C. 154(b) by 561 days.

(21) Appl. No.: 11/079,059

(22) Filed: Mar. 14, 2005

(65) Prior Publication Data

US 2006/0201146 A1 Sep. 14, 2006

(51) Int. Cl.
*F15B 13/16* (2006.01)

(52) U.S. Cl. ..... 91/361; 91/420; 91/421; 91/435

(58) Field of Classification Search ..... 91/361, 91/420, 421, 435, 446, 461
See application file for complete search history.

(56) References Cited

U.S. PATENT DOCUMENTS 3,954,046 A * 5/1976 Stillhard ..... 91/361
4,140,152 A * 2/1979 Budzich ..... 137/596.2
4,353,289 A * 10/1982 Lonnemo ..... 91/420
4,437,385 A * 3/1984 Kramer et al. ..... 91/361
4,977,928 A 12/1990 Smith et al.
5,678,470 A 10/1997 Koehler et al.
5,878,569 A 3/1999 Satzler
5,960,695 A 10/1999 Aardema et al.
6,151,894 A 11/2000 Endo et al.
6,467,264 B1 * 10/2002 Stephenson et al. ..... 60/460
6,502,393 B1 1/2003 Stephenson et al.
6,575,484 B2 * 6/2003 Rogala et al. ..... 280/124.158
6,775,974 B2 8/2004 Tabor
6,880,332 B2 4/2005 Pfaff et al.

* cited by examiner

*Primary Examiner*—Hoang M Nguyen
(74) *Attorney, Agent, or Firm*—Quarles & Brady LLP; George E. Haas

(57) ABSTRACT

A system operates a hydraulic actuator, such as a cylinder, in one of several modes that include powered extension and retraction, self-powering regeneration modes in which fluid exhausting from one cylinder chamber is routed into the other cylinder chamber, and cross function regeneration modes wherein the fluid exhausted from one actuator is routed in the supply conduit to power a different actuator. A controller determines which modes are viable based on existing system conditions and selects from among the viable available modes. That determination is a function of the desired velocity for the actuator, the hydraulic load on the actuator, and pressures in the supply and return hydraulic conduits. The system also can recover potential or kinetic energy through pressure intensification which recovered energy can be used to power another simultaneously active hydraulic function or to drive the prime mover via an over-center variable pump/motor.

25 Claims, 1 Drawing Sheet

HYDRAULIC CONTROL SYSTEM WITH CROSS FUNCTION REGENERATION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to hydraulic systems for operating machinery that have a plurality of functions, each having a separate hydraulic actuator; and more particularly to such systems that operate in a regeneration mode in which pressurized fluid exhausted from one function is routed to power another function.

2. Description of the Related Art

A wide variety of machines have a plurality of moveable members operated by separate hydraulic actuators, such as a cylinder and piston arrangement, controlled by a valve assembly. Conventionally, the valve assembly controls the flow of pressurized fluid into one chamber of the cylinder and the flow of fluid from the other cylinder chamber. Which cylinder chamber receives the pressurized fluid determines the direction of motion of the machine member. The velocity of the piston, and thus the machine member, can be varied by proportionally controlling at least one of those flows.

For that proportional fluid control, the hydraulic actuator is part of a hydraulic circuit branch that has a pair of proportional electrohydraulic valves coupling each cylinder chamber to a supply conduit and another pair of similar valves connecting the cylinder chambers to the tank return conduit. The valves are operated independently, such as by the velocity based method described in U.S. Pat. No. 6,775,974 for example. In that method, the machine operator designates a desired velocity for the hydraulic actuator by manipulating an input device which sends an electrical signal to a system controller. The system controller also receives a sensor signal indicating the amount of force acting on the hydraulic actuator. The desired velocity and force signals are used to determine an equivalent flow coefficient which characterizes fluid flow in the hydraulic circuit branch. From the equivalent flow coefficient, first and second valve flow coefficients are derived and then employed to activate the two of the proportional electrohydraulic valves which control fluid flow to produce the desired motion of the hydraulic actuator. The flow coefficients characterize either conductance or restrictance in the respective section of the hydraulic system. The valve flow coefficients are converted into electrical currents that open the respective valves to produce the associated flow level.

During powered extension and retraction modes of operating the hydraulic cylinder, fluid from a supply conduit is applied to one cylinder chamber and all the fluid exhausting from the other cylinder chamber flows into a return conduit that leads to the system tank. Under some conditions, an external load or other force acting on the machine enables extension or retraction of the cylinder/piston arrangement without significant pressure from the supply conduit. In a backhoe for example, when the bucket is filled with heavy material, the boom can be lowered by the force of gravity.

That force drives fluid out of one chamber of the boom cylinder through the valve assembly and into the tank return conduit. At the same time, an amount of fluid is drawn from the supply conduit through the valve assembly into the other cylinder chamber which is expanding. However, the supply conduit fluid does not have to be maintained at a significant pressure in order for that latter fluid flow to occur. In this situation, the fluid is exhausted from the cylinder under relatively high pressure, thereby containing energy that normally is lost when the pressure is released in the tank.

To optimize efficiency and economical operation of the machine, it is desirable to use the energy of that exhausting fluid, instead of releasing it unused into the tank. Under the proper pressure conditions in some hydraulic systems, fluid being exhausted from one cylinder chamber is routed by the valve assembly to the other cylinder chamber that is expanding. This mode, referred to as "self regeneration", employs the energy of the exhausting fluid to at least partially fill the expanding chamber thereby reducing or eliminating the quantity of fluid from the supply conduit.

Continuing the example of a backhoe, as the boom is lowering, the machine operator may be raising the backhoe arm which requires that fluid under pressure be applied to the hydraulic cylinder for the arm. Therefore, the arm actuator is consuming energy, while the boom cylinder is releasing energy. It would be advantageous if the energy of the exhausted fluid could be channeled to the arm cylinder either to power that cylinder entirely or at least to augment the pressurized fluid furnished by the pump, an operation commonly referred to as "cross function regeneration." In this case the energy from one function may be more efficiently used by another function, than used by the same function in the self regeneration mode. U.S. Pat. No. 6,502,393 describes a hydraulic system that can operate in several modes, including the cross function regeneration mode.

All the various operating modes may not be viable at a given point in time depending on the pressure conditions existing in different sections of the hydraulic system and the external forces acting on components of the machine. Therefore, it is desirable to provide a mechanism that determines which operating modes are currently viable and automatically selects the most economical one that is available.

SUMMARY OF THE INVENTION

A hydraulic system includes an actuator such as, for example, a hydraulic cylinder with a moveable piston that defines a rod chamber and a head chamber in the cylinder. The rod and head chambers are selectively coupled by a valve assembly to a supply conduit carrying pressurized fluid from a source and to a return conduit connected to a tank. However, other types of hydraulic actuators can be employed.

A method for operating the hydraulic system comprises sensing a force acting on the piston. For example the force can be sensed by measuring pressure in at least one of the rod and head chambers or by a force sensor attached to the piston. Another pressure in the hydraulic system, such as in at least one of the supply and tank conduits has a known magnitude. In response to the force and the pressure in the hydraulic system, the method performs at least one of extending the piston from the cylinder and retracting the piston into the cylinder. Extending the piston from the cylinder is performed by operating the valve assembly to connect the head chamber to the return conduit and the rod chamber to the supply conduit thereby sending fluid from the rod chamber into the supply conduit. Retracting the piston into the cylinder is performed by operating the valve assembly to connect the rod chamber to the return conduit and the head chamber to the supply conduit thereby sending fluid from the head chamber into the supply conduit.

DETAILED DESCRIPTION OF THE INVENTION

Figure 1:
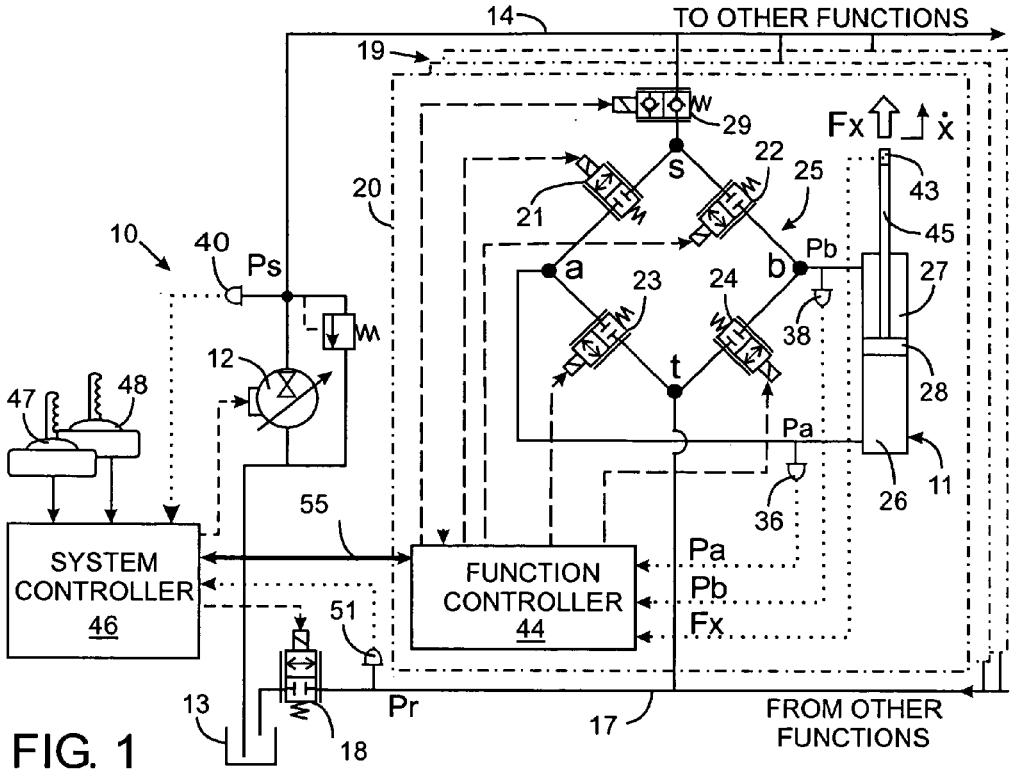
FIG. 1 is a schematic diagram of an exemplary hydraulic system incorporating the present invention.

Referring to FIG. 1, a hydraulic system 10 of a machine has mechanical elements operated by hydraulic actuators, such as cylinder 11 or a rotational motor, for example. The hydraulic system 10 preferably employs a variable displacement pump 12 that is driven by a prime mover, such as an engine or electric motor (not shown), to draw hydraulic fluid from a tank 13 and furnish the hydraulic fluid under pressure into a supply conduit 14. It should be understood that the novel concepts described herein for performing cross function regeneration also can be implemented on hydraulic systems that employ a fixed displacement pump and other types of hydraulic actuators. The supply conduit 14 in standard operating modes furnishes the fluid to a plurality of hydraulic functions 19-20. The fluid returns from the hydraulic functions 19-20 through a return conduit 17 that is connected by tank control valve 18 to the tank 13.

The supply conduit 14 and the return conduit 17 are connected to a plurality of hydraulic functions of the machine on which the hydraulic system 10 is located. One of those functions 20 is illustrated in detail and other functions 19 have similar components for moving other machine members. The exemplary hydraulic system 10 is a distributed type in that the valves and control circuitry of each function are located adjacent the associated hydraulic actuator.

The given function 20 has a valve assembly 25 with a node "s" that is coupled by an electrically reversible check valve 29 to the supply conduit 14. The reversible check valve 29 has a first position in which fluid is allowed to flow only from the supply conduit 14 to node "s", and a second position in which fluid is allowed to flow only from node "s" to the supply conduit 14. The tank return conduit 17 is connected to valve assembly 25 at another node "t". A first workport node "a" of the valve assembly 25 is coupled to a first port for the head chamber 26 of the cylinder 11, and a second workport node "b" is connected to a second port for the cylinder rod chamber 27. Four electrohydraulic proportional valves 21, 22, 23 and 24 control the flow of hydraulic fluid between the nodes and thus the fluid flow to and from the cylinder 11. The first electrohydraulic proportional (EHP) valve 21 is connected between nodes s and a. The second electrohydraulic proportional valve 22 controls flow between nodes "s" and "b", while the third electrohydraulic proportional valve 23, is between node "a" and node "t". The fourth electrohydraulic proportional valve 24, which is located between nodes "b" and "t".

The hydraulic components for the given function 20 also include two pressure sensors 36 and 38 that detect the pressures Pa and Pb within the head and rod chambers 26 and 27, respectively. Another pressure sensor 51 detects the return conduit pressure Pr which appears at node "t" of the function and a further pressure sensor 40 measures the pressure Ps in the supply conduit. These two sensors serve all the functions 19 and 20.

The signals from the four pressure sensors 36, 38, 40 and 51 are applied as inputs to a function controller 44 which operates the four electrohydraulic proportional valves 21-24 to achieve a desired motion of the piston 28 and its rod 45, as will be described. The function controller 44 is a microcomputer based circuit which receives other input signals from a computerized system controller 46. A software program executed by the function controller 44 responds to those input signals by producing output signals that selectively open the four electrohydraulic proportional valves 21-24 by specific amounts to properly operate the cylinder 11.

The system controller 46 supervises the overall operation of the hydraulic system 10, exchanging signals with the function controllers 44 over a communication network 55 using a conventional message protocol. The system controller also receives signals from the supply conduit pressure sensor 40 at the outlet of the pump 12 and the return conduit pressure sensor 51. In response to those pressure signals, the system controller 46 operates the tank control valve 18 and variable displacement pump 12. A plurality of joysticks 47 and 48 are connected to the system controller 46 in order for the machine operator to designate how the hydraulic functions are to operate.

Figure 2:
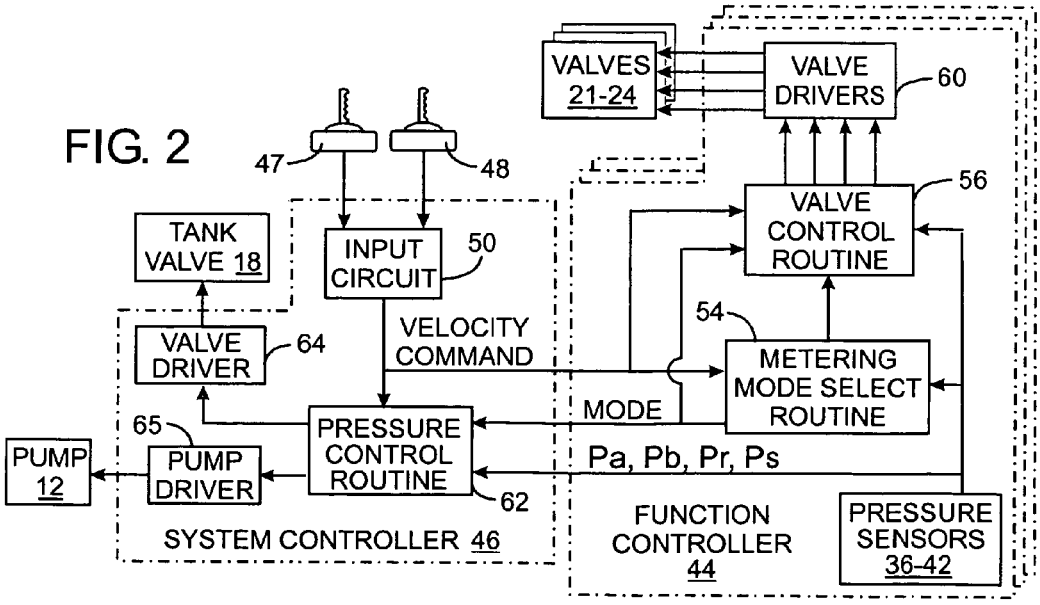
FIG. 2 is a control diagram for the hydraulic system.

With reference to FIG. 2, the tasks associated with controlling the hydraulic system 10 is distributed among the different controllers 44 and 46. Considering operation of a single function 20, the output signal from the corresponding joystick 48 is applied to an input circuit 50 in the system controller 46. The input circuit 50 converts that output signal, which indicates the position of the joystick 48, into a signal designating a desired velocity command for the hydraulic actuator 11 controlled by that joystick. The conversion preferably is implemented by a look-up table stored in the controller's memory. The commanded velocity $\dot{x}$ of the piston rod 45 is arbitrarily defined as being positive in the extend direction.

The velocity command is transmitted from the system controller 46 to the respective function controller 44 which operates the electrohydraulic proportional valves 21-24 that control the hydraulic actuator 11. The hydraulic function 20 can operate in any of several metering modes that determine from where the hydraulic actuator receives fluid and to where the fluid exhausted from the hydraulic actuator is directed.

The fundamental metering modes in which fluid from the pump is supplied via the supply conduit 14 to one of the cylinder chambers 26 or 27 and drained to the return conduit from the other chamber are referred to as powered metering modes, specifically the Standard Powered Extension (Piston Extend) mode and the Standard Powered Retraction (Piston Retract) mode, based on the direction of the piston rod motion.

With reference again to FIG. 1, a given function also may route fluid being exhausted from one chamber 26 or 27 into the other chamber 27 or 26 of the same cylinder. Depending upon whether the fluid is routed through node s or node t of the function's valve assembly 25, the metering mode is referred to as High Side Regeneration or Low Side Regeneration, respectively. During piston retraction, a greater volume of fluid is exhausted from the head chamber 26 than is required in the smaller rod chamber 27 that is expanding. In the Low Side Regeneration mode, that excess fluid flows into the return conduit 17; whereas the excess fluid flows to the supply conduit 14 in the High Side Regeneration mode, provided the supply conduit pressure is not greater than the pressure of the exhausting fluid. When a load tends to collapse the cylinder and the operator commands retraction, the second valve 22 between the supply conduit and the rod chamber can be opened simultaneously with the first valve 21 coupling the supply conduit to the head chamber, which results in the load being carried primarily by only the rod cross sectional area.

This produces pressure intensification and increased capability for driving another simultaneously active function or for driving the prime mover through the over-center variable displacement pump 12. When the piston is being extended from the cylinder 11 by force from the load, a greater volume of fluid is required to fill the head chamber 26 than is exhausting from the smaller rod chamber 27. Thus during an extension in the Low Side Regeneration mode, additional fluid is drawn from the tank return conduit 17, with that fluid coming from another function. When the High Side Regeneration Mode is used to extend the piston, the additional fluid comes from the supply conduit 14.

Under certain pressure conditions within a function, all the fluid exhausted from the cylinder can be fed into the supply conduit 14 to either fully power another simultaneously active hydraulic function or at least supplement fluid being furnished by the pump 12. These "cross function regeneration" modes occur when a large external load is exerting force Fx on the hydraulic actuator 11. When that force tends to retract the piston rod 45, placing the valve assembly 25 in what normally would be the Standard Powered Extension mode (first and fourth valves 21 and 24 open) sends higher pressure fluid from the cylinder head chamber 26 into a lower pressure supply conduit 14. Fluid is drawn into the rod chamber 27 from the return conduit 17. This mode is referred to as Standard Powered Extension (Rod Retract). Similarly when the external force Fx tends to extend the piston rod 45, placing the valve assembly in what normally would be the Standard Powered Retraction mode (second and third valves 22 and 23 open) sends higher pressure fluid from the cylinder rod chamber 27 into a lower pressure supply conduit 14. Fluid is drawn into the head chamber 26 from the return conduit 17. This mode is referred to as Standard Powered Retraction (Piston Extend). Whether one of these latter metering modes is viable depends on the direction of desired piston motion and the relative pressures at the different nodes of the hydraulic function 20.

With reference to FIG. 2, the metering mode for a particular function is chosen by a metering mode selection routine 54 executed by the function controller 44 of the associated hydraulic function 20. This software selection routine 54 determines metering mode in response to the desired direction of piston movement (as designated by the velocity command), the cylinder chamber pressures Pa and Pb, along with the supply and return conduit pressures Ps and Pr at the particular function 20. The relationship of those pressures indicate whether a net pressure, referred to as the "driving pressure", will be applied to the piston 28 for proper operation in a given metering mode. The various metering modes require different driving pressures. Techniques other than measuring the pressures in the supply and return conduits can be used to derive those pressures. For example, if a fixed displacement pump and a pressure regulator always control the supply line pressure to a desired pressure setpoint, that pressure value can be used without having to measure it.

The driving pressures, Peq, required to produce that appropriate movement of the piston 28 for the various metering modes are given by the equations in Table 1.

TABLE 1

METERING MODE DRIVING PRESSURES

| Metering Mode | Driving Pressure |
|---|---|
| Standard Powered Extension (Piston Extend) | Peq = (R * Ps − Pr) − (R * Pa − Pb) |

TABLE 1-continued

METERING MODE DRIVING PRESSURES

| Metering Mode | Driving Pressure |
|---|---|
| High Side Regeneration Extension | Peq = (R * Ps − Ps) − (R * Pa − Pb) |
| Low Side Regeneration Extension | Peq = (R * Pr − Pr) − (R * Pa − Pb) |
| Standard Powered Retraction (Piston Extend) | Peq = (−Ps + R * Pr) + (−R * Pa + Pb) |
| Standard Powered Retraction (Piston Retract) | Peq = (Ps − R * Pr) + (R * Pa − Pb) |
| Low Side Regeneration Retraction | Peq = (Pr − R * Pr) + (R * Pa − Pb) |
| High Side Regeneration Retraction | Peq = (−R * Ps + Ps) + (R * Pa − Pb) |
| Standard Powered Extension (Piston Retract) | Peq = (−R * Ps + Pr) + (R * Pa − Pb) |

In these equations, R is the ratio of the piston surface area in the head chamber 26 of the cylinder 11 to the piston surface area in the rod chamber 27 ($R \geqq 1.0$). In order for a given metering mode to produce motion of the piston and the piston rod in the commanded direction, the corresponding driving pressure (Peq) must not only have a positive value, but also be sufficiently large enough to overcome valve losses.

Whether a particular metering mode is viable at a given point in time is a function of the direction of desired motion and the hydraulic load L acting on the hydraulic actuator (e.g. cylinder 11). In the preferred technique the hydraulic load is calculated according to the expression L=R*Pa−Pb. Alternatively, the hydraulic load can be estimated by measuring the force Fx with a load cell 43 mounted on the piston rod 45 for example, and using the expression L=−Fx/Ab, where Ab is a surface area of the piston in the rod chamber. However, the hydraulic load varies not only with changes in the external force Fx exerted on the piston rod 45, but also with conduit flow losses and cylinder friction changes. Therefore, although this alternative technique is acceptable for certain hydraulic functions, in other cases it may lead to less accurate metering mode transitions because conduit losses and cylinder friction are not taken into account.

If the driving pressure Peq is zero, the forces acting on the cylinder 11 are balanced by the hydraulic pressures and movement does not occur. However, Peq must equal or exceed a value K (i.e. $Peq \geqq K$) that represents cylinder friction, valve losses and conduit losses that must be overcome for motion to occur. When that condition is satisfied, the piston rod 45 moves in the direction designated by the velocity command when the appropriate pair of valves 21-24 in assembly 25 are opened. Using that condition and substituting the hydraulic load L for the term R*Pa−Pb in each equation in Table 1 produces hydraulic load/pressure relationships in Table 2, thereby defining a load range for use in determining whether a given metering mode is viable at a given point in time.

TABLE 2

METERING MODE OPERATING RANGES

| Metering Mode | Hydraulic Load Range |
|---|---|
| Standard Powered Retraction (Piston Extend) | $L \leqq R * Pr - Ps - K$ |
| Low Side Regeneration Extension | $L \leqq R * Pr - Pr - K$ |
| High Side Regeneration Extension | $L \leqq R * Ps - Ps - K$ |
| Standard Powered Extension (Piston Extend) | $L \leqq R * Ps - Pr - K$ |

TABLE 2-continued

METERING MODE OPERATING RANGES

| Metering Mode | Hydraulic Load Range |
|---|---|
| Standard Powered Extension (Piston Retract) | $L \geqq R * Ps - Pr + K$ |
| High Side Regeneration Retraction | $L \geqq R * Ps - Ps + K$ |
| Low Side Regeneration Retraction | $L \geqq R * Pr - Pr + K$ |
| Standard Powered Retraction (Piston Retract) | $L \geqq R * Pr - Ps + K$ |

The metering modes in Table 2 are grouped in quartets according to the direction of piston and piston rod motion, that is extend or retract.

In response to the direction of the commanded velocity, the metering mode selection routine 54 analyzes the corresponding group of four expressions in Table 2 to determine which are true under the present conditions. Because more than one of these expressions may be true, multiple valid metering modes can exist simultaneously. Selection of a particular valid metering mode to use is based on which one provides the most efficient and economical operation, while achieving the desired velocity. The four metering modes in each group are listed in order from that which is generally most efficient and economical to generally least efficient and economical. Therefore, when a plurality of metering modes are viable to use, the one that is highest on the list in Table 2 is selected in most circumstances. For example, to extend the piston rod, the Standard Powered Retraction (Piston Extend) mode is preferred if the hydraulic load is negative. In this case, valves 22 and 23 will be opened as for the Standard Powered Retraction (Piston Retract) mode. However, the negative hydraulic load causes the piston rod to extend, thereby forcing fluid from the rod cylinder chamber 27 into the supply conduit 14 for use by another function. This operation draws fluid into the function from the return conduit to fill the expanding head cylinder chamber 26.

Once selected, the metering mode is communicated to the system controller 46 and to a valve control routine 56 of the respective function controller 44. The valve control routine 56 uses the selected metering mode, the pressure measurements (Pa, Pb, Ps, Pr), and the velocity command to operate the electrohydraulic proportional valves 21-24 in a manner that achieves the commanded velocity of the piston 28. In each metering mode, two of the valves in assembly 25 are active, or open. The metering mode defines which pair of valves to open and the valve control routine 56 determines the amount that each of those valves is to open based on the pressures and the commanded velocity $\dot{x}$. This results in a set of four output signals which the valve control routine 56 sends to a set of valve drivers 60 that produce electric current levels for proportionally operating the selected ones of the electrohydraulic valves 21-24. The valves can be operated according to a velocity based method, such as the one described in U.S. Pat. No. 6,775,974 which description is incorporated by reference herein.

Specifically, in the Standard Powered Retraction (Piston Extend) mode the second and third electrohydraulic proportional (EHP) valves 22 and 23 are opened. Although this pair of valves was opened in previous hydraulic systems only to retract the piston 28 into the cylinder 11, opening these valves under the conditions defined for the Standard Powered Retraction (Piston Extend) mode extends the piston because the external force acting to extend the piston is greater than the force on the piston due to pressure from the supply conduit 14. Under that force relationship the piston 28 extends from the cylinder 11. For the Low Side Regeneration Extension mode, the third and fourth EHP valves 23 and 24 are opened and the first and second EHP valves 21 and 22 are opened for the High Side Regeneration Extension mode. In the Standard Powered Extension (Piston Extend) mode the first and fourth EHP valves 21 and 24 are open.

The first and fourth EHP valves 21 and 24 also are opened in Standard Powered Extension (Piston Retract) mode. However, because when this latter mode is selected the external force tending to retract the piston 28 is greater than the force on the piston due to pressure from the supply conduit 14, the piston retracts into the cylinder 11. In High Side Regeneration Retraction mode the first and second EHP valves 21 and 22 are opened, while the third and fourth EHP valves 23 and 24 are open in the Low Side Regeneration Retraction mode. For the Standard Powered Retraction (Piston Retract) mode the second and third EHP valves 22 and 23 are opened.

The valves that are opened in the various metering modes are summarized in Table 3.

TABLE 3

METERING MODE OPERATING RANGES

| Metering Mode | Valves Opened |
|---|---|
| Standard Powered Retraction (Piston Extend) | second and third valves |
| Low Side Regeneration Extension | third and fourth valves |
| High Side Regeneration Extension | first and second valves |
| Standard Powered Extension (Piston Extend) | first and fourth valves. |
| Standard Powered Extension (Piston Retract) | first and fourth valves |
| High Side Regeneration Retraction | first and second valves |
| Low Side Regeneration Retraction | third and fourth valves |
| Standard Powered Retraction (Piston Retract) | second and third valves. |

In order to achieve the commanded velocity $\dot{x}$, the system controller 46 operates the variable displacement pump 12 to produce a pressure level in the supply conduit 14 which meets the fluid supply requirements of all the hydraulic functions in the hydraulic system 10. For that purpose, the system controller 46 executes a pressure control routine 62 which determines a separate pump supply pressure setpoint (Ps setpoint) to meet the needs of each active machine function operating in a metering mode that consumes fluid from the supply conduit 14. The supply pressure setpoint having the greatest value is selected as the supply conduit pressure command, which is sent to the pump driver 65 that controls the variable displacement pump 12 to produce the requisite pressure in the supply conduit 14.

The system controller 46 also operates the tank control valve 18 to control the pressure level in the return conduit 17 to meet the pressure requirements of all the hydraulic functions 19 and 20. The pressure control routine 62 similarly calculates a return conduit pressure setpoint for each function of the hydraulic system 10 that is operating in a metering mode that consumes fluid from the return conduit. The greatest of those function return conduit pressure setpoints is selected as the return conduit pressure command which is used by the valve drive 64 in operating the tank control valve 18 to achieve that pressure level.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. In a hydraulic system that includes a plurality of hydraulic functions connected to a supply conduit carrying pressurized fluid from a source and to a return conduit connected to a tank, each hydraulic function comprising a hydraulic actuator with a first port and a second port that are coupled by a valve assembly to the supply conduit and to the return conduit, a method for controlling one hydraulic function comprising:

receiving a command designating desired motion of the hydraulic actuator;

sensing a hydraulic load acting on the hydraulic actuator;

deriving a pressure value denoting a pressure present in the hydraulic system; and in response to the command, the hydraulic load and the pressure value, operating the valve assembly in a metering mode in which fluid from the return conduit flows into the hydraulic actuator and fluid flows from the hydraulic actuator into the supply conduit.

2. The method as recited in claim 1 wherein deriving a pressure value comprises determining pressure of fluid in at least one of the supply conduit and the return conduit.

3. The method as recited in claim 1 wherein deriving a pressure value comprises sensing pressure in the supply conduit and sensing pressure in the return conduit.

4. The method as recited in claim 1 wherein:

the hydraulic actuator comprises cylinder with a piston that defines a rod chamber and a head chamber in the cylinder; and the metering mode comprises one of:

(a) extending the piston from the cylinder by operating the valve assembly to connect the head chamber to the return conduit and the rod chamber to the supply conduit thereby sending fluid from the rod chamber into the supply conduit, and (b) retracting the piston into the cylinder by operating the valve assembly to connect the rod chamber to the return conduit and the head chamber to the supply conduit thereby sending fluid from the head chamber into the supply conduit.

5. The method as recited in claim 4 wherein sensing a hydraulic load comprises sensing pressure of fluid in at least one of the rod chamber and the head chamber.

6. The method as recited in claim 4 wherein extending the piston from the cylinder occurs when pressure in the supply conduit is less than pressure in the rod chamber.

7. The method as recited in claim 4 wherein extending the piston from the cylinder is performed when the hydraulic load L acting on the piston satisfies the expression $L \leqq R*Pr-Ps-K$, where R is the ratio of a surface area of the piston in the head chamber to a surface area of the piston in the rod chamber, Ps is pressure in the supply conduit, Pr is pressure in the return conduit, and K is a value representing losses in the hydraulic system.

8. The method as recited in claim 4 wherein retracting the piston into the cylinder is performed when pressure in the supply conduit is less than pressure in the head chamber.

9. The method as recited in claim 4 wherein retracting the piston into the cylinder is performed when the hydraulic load L acting on the piston satisfies the expression $L \geqq R*Ps-Pr+K$, where R is the ratio of a surface area of the piston in the head chamber to a surface area of the piston in the rod chamber, Ps is pressure in the supply conduit, Pr is pressure in the return conduit, and K is a value representing losses in the hydraulic system.

10. The method as recited in claim 4 wherein:

the valve assembly comprises a first valve coupling the head chamber to a supply conduit carrying pressurized fluid from a source, a second valve coupling the rod chamber to the supply conduit, a third valve coupling the head chamber to a return conduit connected to a tank, and a fourth valve coupling the rod chamber to the return conduit; and further comprising;

extending the piston from the cylinder is performed by opening the second valve and third valve; and retracting the piston into the cylinder is performed by opening the first valve and fourth valve.

11. In a hydraulic system that includes a plurality of hydraulic functions connected to a supply conduit carrying pressurized fluid from a source and to a return conduit connected to a tank, at least one hydraulic function comprising a cylinder with a piston that defines a rod chamber and a head chamber in the cylinder, a first valve coupling the head chamber to the supply conduit, a second valve coupling the rod chamber to the supply conduit, a third valve coupling the head chamber to the return conduit, and a fourth valve coupling the rod chamber to the return conduit, a method for operating the at least one hydraulic function comprising:

receiving a command designating desired motion of the piston;

determining a hydraulic load acting on the cylinder;

indicating a first pressure present in the supply conduit;

indicating a second pressure present in the return conduit;

in response to the command, the hydraulic load, the first pressure and the second pressure, selecting a metering mode from among a Standard Powered Retraction (Piston Extend) mode, a Standard Powered Extension (Piston Extend) mode, a Standard Powered Extension (Piston Retract) mode, and a Standard Powered Retraction (Piston Retract) mode; and in response to the metering mode selected, opening two of the first, second, third and fourth valves as defined in the following table:

| Metering Mode | Valves Opened |
|---|---|
| Standard Powered Retraction (Piston Extend) | second and third valves |
| Low Side Regeneration Extension | third and fourth valves |
| High Side Regeneration Extension | first and second valves |
| Standard Powered Extension (Piston Extend) | first and fourth valves. |
| Standard Powered Extension (Piston Retract) | first and fourth valves |
| High Side Regeneration Retraction | first and second valves |
| Low Side Regeneration Retraction | third and fourth valves |
| Standard Powered Retraction (Piston Retract) | second and third valves. |

12. The method as recited in claim 11 wherein selecting a metering mode also can choose from among a Low Side Regeneration Extension mode, a High Side Regeneration Extension mode, a High Side Regeneration Retraction mode, and a Low Side Regeneration Retraction mode.

13. The method as recited in claim 11 wherein selecting a metering mode comprises:

determining whether the piston is to be extended from or retracted into the cylinder in response to the hydraulic load L; and choosing a given metering mode based on whether a hydraulic load/pressure relationship given in the following table is satisfied for that given metering mode

| Metering Mode | Hydraulic Load Pressure Relationship |
|---|---|
| Standard Powered Retraction (Piston Extend) | $L \leqq R * Pr - Ps - K$ |
| Low Side Regeneration Extension | $L \leqq R * Pr - Pr - K$ |
| High Side Regeneration Extension | $L \leqq R * Ps - Ps - K$ |
| Standard Powered Extension (Piston Extend) | $L \leqq R * Ps - Pr - K$ |
| Standard Powered Extension (Piston Retract) | $L \geqq R * Ps - Pr + K$ |
| High Side Regeneration Retraction | $L \geqq R * Ps - Ps + K$ |
| Low Side Regeneration Retraction | $L \geqq R * Pr - Pr + K$ |
| Standard Powered Retraction (Piston Retract) | $L \geqq R * Pr - Ps + K$ |

where R is the ratio of a surface area of the piston in the head chamber to a surface area of the piston in the rod chamber, Ps is pressure in the supply conduit, Pr is pressure in the return conduit, and K is a value representing losses in the hydraulic system.

14. The method as recited in claim 13 wherein when the hydraulic load/pressure relationship for more than one given metering mode is satisfied selecting the first such metering mode in an order specified in the table that produces piston motion in a direction designated by the command is selected.

15. The method as recited in claim 13 further comprising:

sensing a third pressure in the head chamber;

sensing a fourth pressure in the rod chamber; and calculating the hydraulic load L in response to the third pressure and the fourth pressure.

16. The method as recited in claim 15 wherein the hydraulic load L is determined according to the expression $L=R*Pa-Pb$, where R is a ratio of a surface area of the piston in the head chamber to a surface area of the piston in the rod chamber, Pa is pressure in the head chamber, Pb is pressure in the rod chamber.

17. The method as recited in claim 15 further comprising wherein the hydraulic load L is determined by sensing a force Fx acting on the piston and employing the expression $L=-Fx/Ab$, where Ab is a surface area of the piston in the rod chamber.

18. In a hydraulic system that includes a plurality of hydraulic functions connected to a supply conduit carrying pressurized fluid from a source and to a return conduit connected to a tank, at least one hydraulic function comprising hydraulic actuator with a first port and a second port, a first valve coupling the first port to the supply conduit, a second valve coupling the second port to the supply conduit, a third valve coupling the first port to the return conduit, and a fourth valve coupling the second port to the return conduit, a method for operating the at least one hydraulic function comprising:

receiving a command designating desired motion of the hydraulic actuator;

sensing a parameter that indicates a magnitude of a hydraulic load acting on the hydraulic actuator;

sensing pressure in the hydraulic system; and in response to the command, the hydraulic load and the pressure, selecting a metering mode among a first metering mode in which the first and fourth valves are opened wherein fluid from the supply conduit drives the hydraulic actuator in a first direction, a second metering mode in which the second and third valves are opened wherein fluid from the supply conduit drives the hydraulic actuator in a second direction, and a third metering mode in which the first and fourth valves are opened while the hydraulic actuator is moving in the second direction wherein fluid flow from the hydraulic actuator into the supply conduit and from the return conduit to the hydraulic actuator.

19. The method as recited in claim 18 wherein selecting a metering mode also can choose from among a fourth metering mode in which the second and third valves are opened while the hydraulic actuator is moving in the first direction wherein fluid flow from the hydraulic actuator into the supply conduit and from the return conduit to the hydraulic actuator.

20. The method as recited in claim 18 wherein sensing pressure in the hydraulic system comprises sensing pressure in at least one of the supply conduit and the return conduit.

21. The method as recited in claim 18 wherein sensing a parameter comprises sensing pressure of fluid adjacent at least one of the first port and the second port.

22. The method as recited in claim 18 further comprising connecting the first valve and the second valve to the supply conduit through a reversible check valve.

23. In a hydraulic system that includes a plurality of hydraulic functions connected to a supply conduit carrying pressurized fluid from a source and to a return conduit connected to a tank, each hydraulic function comprising a piston-cylinder arrangement with a first chamber and a second chamber both coupled by a valve assembly to the supply conduit and to the return conduit, a method for operating one hydraulic function comprising:

receiving a command designating desired motion of the hydraulic actuator;

sensing a hydraulic load acting on the hydraulic actuator;

sensing a pressure value denoting a pressure present in the hydraulic system; and in response to the command, the hydraulic load and the pressure value, operating the valve assembly to direct fluid from the first chamber into both the second chamber and the supply conduit.

24. The method as recited in claim 23 wherein operating the valve assembly produces retraction of the piston-cylinder arrangement.

25. The method as recited in claim 23 wherein sensing a pressure value comprises determining pressure of fluid in at least one of the supply conduit and the return conduit.

* * * * *